US008951007B2

(12) United States Patent
Botsch et al.

(10) Patent No.: US 8,951,007 B2
(45) Date of Patent: Feb. 10, 2015

(54) TURBINE HOUSING FOR AN EXHAUST GAS TURBOCHARGER AND METHOD FOR PRODUCING TURBINE HOUSING

(75) Inventors: Siegfried Botsch, Grafenau (DE); Stephan Krätschmer, Schwäbisch Gmünd (DE); Markus Müller, Waiblingen (DE); Siegfried Sumser, Stuttgart (DE)

(73) Assignee: Daimler AG, Stuttgart (DE)

( * ) Notice: Subject to any disclaimer, the term of this patent is extended or adjusted under 35 U.S.C. 154(b) by 701 days.

(21) Appl. No.: 13/136,540

(22) Filed: Aug. 3, 2011

(65) Prior Publication Data

US 2011/0318177 A1 Dec. 29, 2011

Related U.S. Application Data

(63) Continuation-in-part of application No. PCT/EP2010/000470, filed on Jan. 27, 2010.

(30) Foreign Application Priority Data

Feb. 5, 2009 (DE) ..... 10 2009 007 736

(51) Int. Cl.
*F01D 25/28* (2006.01)
*F01D 25/24* (2006.01)

(52) U.S. Cl.
CPC ..... *F01D 25/246* (2013.01); *F05D 2230/21* (2013.01); *F05D 2230/232* (2013.01); *F05D 2220/40* (2013.01)
USPC ..... 415/158; 415/186; 415/189; 415/205

(58) Field of Classification Search
USPC ..... 415/134, 135, 151, 156, 158, 167, 415/173.3, 174.2, 184, 186, 189, 203, 204, 415/205, 206, 212.2; 29/889.2
See application file for complete search history.

(56) References Cited

U.S. PATENT DOCUMENTS 4,384,821 A * 5/1983 Mains et al. ..... 415/136
4,894,990 A 1/1990 Tsubouchi (Continued)

FOREIGN PATENT DOCUMENTS

DE 102 58 466 7/2003
DE 10 2005 027 080 12/2006

(Continued)

OTHER PUBLICATIONS

EP 1357278 A2 Machine Translation.*

(Continued)

*Primary Examiner* — Edward Look
*Assistant Examiner* — Juan G Flores
(74) *Attorney, Agent, or Firm* — Klaus J. Bach

(57) ABSTRACT

In the turbine housing for an exhaust gas turbocharger of a drive assembly at least one spiral channel, which can be coupled to an exhaust gas line of the drive assembly is provided A receiving chamber for a turbine wheel to which exhaust gas can be supplied is disposed upstream of the at least one spiral channel. The turbine wheel is disposed in the turbine housing so as to be rotatable about a rotational axis. A guide baffle is arranged fixed to the turbine housing in a transition region between the at least one spiral channel, the guide baffle being connected to the turbine housing by a metal-to-metal joint whereby the guide baffle is connected to the turbine housing in a particular tight manner.

16 Claims, 4 Drawing Sheets

(56) References Cited

U.S. PATENT DOCUMENTS

| | | | | |
|---|---|---|---|---|
| 5,522,697 | A * | 6/1996 | Parker et al. | 415/158 |
| 6,945,046 | B2 * | 9/2005 | Allmang et al. | 60/602 |
| 2002/0085932 | A1 * | 7/2002 | Loffler et al. | 417/407 |
| 2007/0089414 | A1 * | 4/2007 | Yokoyama et al. | 60/605.1 |
| 2007/0209361 | A1 * | 9/2007 | Pedersen et al. | 60/602 |
| 2008/0152484 | A1 | 6/2008 | Fledersbacher et al. | |
| 2008/0223039 | A1 * | 9/2008 | Sumser et al. | 60/612 |

FOREIGN PATENT DOCUMENTS

| | | | | |
|---|---|---|---|---|
| EP | 1357278 | A2 * | 10/2003 | |
| EP | 1 428 983 | | 6/2004 | |
| GB | 2 210 668 | | 6/1989 | |
| JP | 62 029723 | | 7/1987 | |
| JP | 62265405 | | 11/1987 | |
| JP | 63 111238 | | 5/1988 | |
| JP | 01 130037 | | 9/1989 | |
| JP | 01 092531 | | 11/1989 | |
| JP | 2003 184563 | | 3/2003 | |
| JP | 2003 314290 | | 11/2003 | |
| JP | 2004 144029 | | 5/2004 | |
| JP | 2007192180 | A * | 8/2007 | F02B 39/00 |
| JP | 2008 196452 | | 8/2008 | |
| JP | 2011-548577 | | 1/2010 | |
| WO | WO 2007/135449 | | 11/2007 | |
| WO | WO 2008/098024 | | 3/2008 | |

OTHER PUBLICATIONS

EP 1357278 A2 Machine Translation, Oct. 2003, Grussmann et al.*

* cited by examiner

TURBINE HOUSING FOR AN EXHAUST GAS TURBOCHARGER AND METHOD FOR PRODUCING TURBINE HOUSING

This is a Continuation-In-Part application of pending international patent application PCT/EP2010/000470 filed Jan. 27, 2010 and claiming the priority of German patent application 10 2009 007 736.7 filed Feb. 5, 2009.

BACKGROUND OF THE INVENTION

The invention relates to a turbine housing for an exhaust gas turbocharger of a drive assembly, the turbine housing having at least one spiral channel, that can be coupled to an exhaust gas line of the drive assembly, and a receiving chamber including a turbine wheel which is arranged downstream of the at least one spiral channel and to which exhaust gas can be supplied. The turbine wheel is rotatably supported in the turbine housing and a guide baffle is arranged fixed to the turbine housing in a transition region between the at least one spiral channel and the receiving chamber. The invention further relates to a method for producing a turbine housing.

Such a turbine housing is known from DE 10 2005 027 080 A1. The turbine housing for an exhaust gas turbocharger of an internal combustion engine shown therein has a spiral channel, which can be coupled to an exhaust gas line, of the internal combustion engine. A turbine wheel is arranged downstream of the spiral channel, which turbine wheel is rotatable in the turbine housing around a rotational axis. A guide baffle is arranged fixed to the turbine housing in a transition region between the spiral channel and the turbine wheel. The turbine housing further has an axial slider that can be displaced in the direction of the rotational axis, by means of which the guide baffle can be covered more or less. By displacing the axial slider, a cross section in the transition region through which the exhaust gas flows can be changed. Depending on the axial position of the axial slider, a different turbine inlet cross section can be adjusted. In order to arrange the guide baffle fixed to the turbine housing, the turbine housing is clamped to a bearing housing, in which a shaft is mounted, which is connected to the turbine wheel in a rotationally fixed manner.

Because of the continuing tightening of emission limits, particularly for nitrogen oxides and soot, the requirements of exhaust gas turbochargers or of charged internal combustion engines also increase. Thus, there are growing demands with regard to the charge pressure availability over average to high load ranges of the internal combustion engine, whereby exhaust gas turbochargers have to be more and more decreased in size. In other words, the required high turbine performances of exhaust gas turbochargers are realized by an increase of the retention capability or by a decrease of the intake capability of the exhaust gas turbocharger in connection with the respective internal combustion engine. In order to hereby counteract a decrease of the efficiency of the turbine, the provision of a flow guide baffle in the transition region between the at least one spiral channel and the turbine wheel has proven to be advantageous.

A further influencing of the performance capability of an exhaust gas turbocharger is possible by means of exhaust gas treatment devices arranged in the exhaust gas line downstream of the turbine, which can comprise a particle filter, a catalyst and/or a SCR system (SCR=selective catalytic reduction). These exhaust gas treatment devices lead to a pressure increase at the outlet side of the turbine housing or of the exhaust gas turbocharger. In order to obtain a sufficient turbine pressure drop for providing a satisfying performance of the exhaust gas turbocharger, the pressure upstream of the turbine also has to be increased. The quotient of the pressure in front of the turbine and of the pressure behind the turbine has to be determined hereby as the turbine pressure drop.

A design of the turbine of a particularly small size can hereby satisfy the performance requirement of the compressor side of the exhaust gas turbocharger, but is accompanied by lower efficiencies of the turbine. A certain improvement, in particular for internal combustion engines with exhaust gas recirculation systems, can be achieved with exhaust gas turbochargers known from the state of the art, whose turbine housings comprise two spiral channels through which exhaust gas can flow independently and which are usually formed in an asymmetric manner. The spiral channels are respectively coupled to different exhaust gas strands of the exhaust gas line of the internal combustion engine. However, the spiral channels have also reached such small spiral sizes that the flow losses are very high as a result of wall friction due to the small dimensions. Additionally, certain problems exist with regard to the exhaust gas recirculation capability in connection with the necessary combustion air of the internal combustion engine in particular in the lower to the medium speed range.

It is the object of the present invention to provide a turbine housing of the type mentioned at the outset, where the guide baffle is arranged at the turbine housing in a particularly tight manner.

SUMMARY OF THE INVENTION

The turbine housing for an exhaust gas turbocharger of a drive assembly according to the invention has at least one spiral channel, which can be coupled to an exhaust gas line of the drive assembly. A receiving chamber for a turbine wheel to which exhaust gas can be supplied is provided upstream of the at least one spiral channel. The turbine wheel is disposed in the turbine housing so as to be rotatable about a rotational axis. A guide baffle is arranged fixed to the turbine housing in a transition region between the at least one spiral channel, wherein the guide baffle is connected to the turbine housing by a metal-to-metal joint whereby, the guide baffle is connected to the turbine housing in a particular tight manner.

The invention is based on the knowledge that manufacturing tolerances can lead to leaks with guide baffle or vane structure mounted in the turbine housing, which are accompanied by noticeable efficiency losses of the turbine. Additionally or alternatively, temperature differences between components of the turbine housing and the guide vane caused by operation can lead to leaks around the guide baffle deteriorating the efficiency of the turbine. If the guide vane structure is connected adhesively to the turbine housing at least in regions, the metal-to-metal connection of the guide vane structure and the turbine housing has a particularly low leak susceptibility. In other words, a particularly high tightness can thus be achieved, particularly gas tightness. As a drive assembly, a system different from the internal combustion engine can also be used, for example a fuel cell system.

According to an advantageous arrangement of the invention, the guide baffle is welded to the turbine housing on at least one face side at least in regions, particularly in a gas-tight manner. By means of the welding, a particularly safe fixing of the guide baffle at the turbine housing is obtained.

The guide baffle can hereby be welded on one side, particularly to the face side lying closer to an outlet channel of the turbine housing. Additionally or alternatively, the weld connection with the turbine housing can take place at the face side, which is arranged closer to a bearing housing that may be fixed to the turbine housing.

Additionally or alternatively, the guide baffle can be cast into the turbine housing at one face side at least in regions, particularly in a gas-tight manner. By means of the casting, a gas-tight fixing of the guide baffle at the turbine housing can also be achieved. A one-sided or a two-sided fixing of the guide baffle to the turbine housing is also possible.

The guide baffle is suitable for a respective turbine housing in dependence on operating conditions of the drive assembly and can be fixed permanently by welding or casting in this manner and without any leaks occurring at the turbine housing during operation.

With the casting method, the guide baffle can be present as a pre-manufactured part, and be arranged between the at least one spiral channel and the receiving region for the turbine wheel fixed to the turbine With the casting method, the guide baffle can be present as a pre-manufactured part, and be arranged between the at least one spiral channel and the receiving region for the turbine wheel fixed to the turbine housing in the transition region by casting. It is however also conceivable that the turbine housing part to which the guide vane is connected, has the at least one spiral channel, and the guide vane structure are manufactured parts. These manufactured parts can then be connected by partial melting by means of a casting method. Only the turbine housing part, which has the at least one spiral channel can also be provided as a manufactured part, and the guide baffle be connected to the turbine housing part by means of the casting method.

It has further been shown to be advantageous if a surface of the guide baffle connected to the turbine housing is formed in a profiled manner at least in regions. A form-fit is thereby provided in addition to the adhesive connection of guide baffle and turbine housing, which serves for a particularly safe fixing of the guide baffle to the turbine housing. Furthermore, an enlarged connectable surface of the guide baffle is provided in this manner, which ensures a particularly large rigidity and tightness of the connection when connecting the surface by means of welding and also by means of the casting method.

In an advantageous arrangement of the invention, the turbine housing is formed at least in first and second parts, wherein the second partial housing comprises an outlet channel and can be fixed to the first partial housing comprising the at least first spiral channel. The second partial housing can be mounted to the first partial housing independently thereof so that a good accessibility is particularly given for the welding of the guide baffle to the second partial housing in an advantageous manner.

For the connection of the guide baffle to the turbine housing it is also advantageous if the second partial housing can subsequently be fixed to the first partial housing. It is particularly possible hereby to rework the guide baffle and/or the first partial housing prior to the mounting of the second partial housing, in order to keep the transition region and/or the guide baffle within predefined tolerances which need to be kept due to thermodynamic conditions in this manner. With such a reworking, a chip removing method can particularly be used. By means of such a precise reworking, a particularly high efficiency of the turbine can be achieved.

As long as the second partial housing of the turbine housing comprising the outlet channel is not yet fixed to the first partial housing comprising at least one spiral channel, a relatively large space is present in particular for an automatic welding method, for example a laser or an electron beam welding, for welding the guide baffle to the first partial housing. The introduction of the guide baffle into the first partial housing however takes place from the side of the first partial housing near the bearing housing.

It is furthermore advantageous if the turbine housing has a second spiral channel that can be coupled to the exhaust gas line of the drive assembly, which is separated from the at least one spiral channel by means of an intermediate wall, wherein the guide baffle is connected to the intermediate wall at least in regions. A retention capability of one of the at least two spiral channels is thus provided by means of the guide baffle, without the spiral channel having to be designed small for achieving the retention capability and thus with comparatively large flow losses. In alternative embodiments, more than two spiral channels can also be formed in the turbine housing.

An asymmetric property of the turbine housing can thus be achieved by the guide baffle. It is particularly possible hereby to assign the spiral channel designed for an exhaust gas flow that is retained to a greater extent to an exhaust gas recirculation line. By means of the comparatively high retention of the exhaust gas in the spiral channel, which comprises the guide baffle connected to the intermediate wall, this spiral channel can be connected to a strand of the exhaust gas line, from which exhaust gas is supplied to the charge air.

If the intermediate wall is connected to the guide baffle in a form-fit manner, mechanical strains in the intermediate wall can be reduced by sliding support thereof in the bearing region.

By the connection of the guide baffle to the intermediate wall for example by welding or casting, a gas-tight separation with respect to the second spiral channel can be achieved. Due to reasons of space it is sensible here to arrange the guide baffle in the transition region of the first spiral channel which is closer to the bearing housing than the second spiral channel.

It is hereby advantageous if the intermediate wall is formed in one piece with the guide baffle at least in regions. The separation of the spiral channels can thus be achieved by a pre-manufactured part which is formed integrally with the guide baffle and thus in a particularly exact manner. With the one-piece forming of the intermediate wall with the guide baffle, the guide baffle and the intermediate wall can be formed as a cast part, particularly fine cast part or exact cast part and be provided as an integral part.

The intermediate wall can hereby be formed in one piece with the guide baffle from a tongue region, in which the transfer of the exhaust gas from the spiral channel takes place to the turbine wheel up to an inlet flange of the turbine housing. At the inlet flange of the turbine housing a strand of the exhaust gas line assigned to the respective spiral channel can be coupled to the respective spiral channel.

It can alternatively be provided that the intermediate wall is formed in regions in one piece with the partial housing of the turbine housing comprising the spiral channels. Hereby, particularly the section of the intermediate wall to be connected to the tongue region is to be formed in one piece with the guide baffle in an advantageous manner and to connect it for example by casting to the partial housing comprising the spiral channels.

In a further advantageous manner, the intermediate wall comprises an anchoring part embedded into the turbine housing. A form-fit between the intermediate wall and the turbine housing can be achieved by means of the anchoring part, whereby a particularly safe fixing of the intermediate wall to the turbine housing can be achieved. The anchoring part can be designed as a region of the intermediate wall with a widened cross section, which is embedded into the turbine housing in the casting process in a form-fit manner. A hook-shaped forming of the anchoring part or a forming of a T profile is also possible.

According to a further advantageous arrangement of the invention, the intermediate wall has at least one compensating region, by means of which a different thermal expansion of the spiral channels and of the guide baffle can be compensated for at least partially. A curvature or a sequence of several curvatures can be provided in the intermediate wall to form such a compensating region. Temperature spreads by different thermal expansions of the spiral channels and of the guide baffle can thus be compensated without tension increases. The compensating region can particularly have a corrugated form. Different relative expansions between the spiral channels, the guide baffle and the intermediate wall themselves can thus be controlled particularly well.

It has further been shown to be advantageous if the intermediate wall is formed of a metal sheet at least in regions, which is welded to the guide baffle, particularly in a gas-tight manner. When welding the intermediate wall formed of a metal sheet, an automatic welding method, for example based on a laser or electron beam welding process can be used. Such an integral part comprising the intermediate wall and the guide baffle can then be fixed to the turbine housing by casting. Alternatively, the intermediate wall can be connected to the guide baffle in a form-fit manner. The connection of the intermediate wall to the turbine housing can also take place in a form-fit manner.

Such an integral part can thus be produced in a particularly precise manner with particularly low manufacturing tolerances. By means of the smooth surfaces of the metal sheet, a flow loss of the exhaust gas when flowing through the spiral channels is additionally particularly low.

Compared to this, the step of the subsequent connection of the intermediate wall to the guide baffle is not necessary with the integral part of the guide baffle and the intermediate wall formed as a one-piece cast part.

According to a further advantageous arrangement of the invention, a flow guide element can be arranged between the second spiral channel and the receiving chamber for the turbine wheel, by means of which at least two flow states different from each other can be adjusted in the transition region. Such a flow guide element can comprise an axially displaceable guide baffle, an axial slider for the different covering of a guide baffle or a similar vario device. By means of such a vario device for adjusting the turbine geometry, flow states can be adjusted to a plurality of operating conditions. A turbo brake functionality can particularly be provided by means of such a flow guide element. By reducing the cross section in the transition region between the second spiral channel and the turbine wheel by means of the flow guide element, an exhaust gas counter pressure can be adjusted using the flow guide element for the turbo brake functionality, which acts in a braking manner on the output shaft of the internal combustion engine.

In an advantageous manner, the flow element is hereby integrated into the second partial housing comprising the outlet channel. On the side of this outlet channel, less tight space relationships are present in an advantageous manner for providing the vario device than on a side of the turbine housing near the bearing housing.

Particularly, the second spiral channel can thus be used independently of the spiral channel having the guide baffle connected to the intermediate wall, in order to adapt the turbine to requirements of the drive assembly, for example of the internal combustion engine. The flow element arranged in the transition region between the second spiral channel and the receiving chamber for the turbine wheel thus provides a variability of the turbine geometry and the provision of the turbo brake functionality. Compared to this, the spiral channel, in whose transition region the guide baffle connected to the intermediate wall is arranged provides for a retention capability, which enables an exhaust gas recirculation over a wide speed range, particularly already in the lower and medium speed range.

In an advantageous manner, a cross section of the second spiral channel that can be flown through is at least substantially the same as the cross section of the at least one spiral channel that can be flown through. With such a symmetrical turbine, for example with two flutes, only low flow losses result in an advantageous manner even in the spiral channel used for the exhaust gas return, that is, the guide vane connected to the intermediate wall. By providing the guide vane connected to the intermediate wall, properties of an asymmetrical turbine can still be achieved. In the spiral channel which is comparatively large with the guide baffle connected to the intermediate wall, the exhaust gas flows in a particularly low-loss manner during operation of the drive assembly, particularly the internal combustion engine. The acceleration of the exhaust gas providing a particularly good inflow of the turbine is then achieved is a particularly short path by means of the guide baffle.

In a further advantageous arrangement of the invention, the turbine housing and the guide baffle formed particularly as a fine cast part or exact cast part, consist of the same material, particularly steel cast material, at least in regions. By the choice of the same materials, a connection of the guide baffle and the turbine housing by welding and/or casting can be done in a particularly good manner. The material 1.4849 can for example be used as steel cast material. Such a steel cast material is distinguished amongst others by a particularly high freedom of cracking.

If the turbine housing and the guide baffle are formed of a steel cast material, the gas-tight connection of the cast parts is facilitated. Particularly good thermodynamic results can hereby be achieved if the guide baffle is formed as a fine cast part or exact cast part. Such a fine cast part or exact cast part has a particularly high accuracy. Compared to this, the turbine housing can be formed with lower accuracy requirements with regard to the manufacture of the cast part, and can be, for example, a sand cast part.

These cast parts manufactured with differently exact casting methods, which have the same material at least at connection areas, can be connected well in a gas-tight manner by means of the casting method and/or by welding.

An embodiment of the turbine housing where the at least one spiral channel has an inner part formed particularly of metal sheet through which exhaust gas flows has been shown to be furthermore advantageous, in that a thermally insulating gap is formed between an outer shell of the at least one spiral channel and the inner part at least in regions. Such an inner design of the at least one spiral channel is particularly advantageous if the turbine housing is to be used with an internal combustion engine, where particularly high exhaust gas temperatures can occur. A use with Otto engines or with Diesel engines with a high performance density and correspondingly low lambda values is for example conceivable.

The flow guide of the exhaust gas is hereby subject to the geometric design of the inner part, which is for example formed of a metal sheet as two inner part shells connected to each other in a gas-tight manner. Compared to this, the outer shell of the spiral channel serves as a supporting corset for the flow-guiding inner part. As the outer shell does not serve for the flow guide of the exhaust gas, it can be manufactured in a particularly cost-efficient manner, for example as an iron cast part. As a further cost-efficient alternative, an aluminum alloy can also be used for the outer shell. The outer shell of the at least one spiral channel further provides a force transfer between the turbine inlet flange, the bearing housing and a turbine outlet flange.

The inner part can be connected to the outer shell serving as a supporting corset by means of a casting method. Alternatively, a form-fit connection of the outer shell and the inner part can be provided. The positioning and fixing of the inner part at the at least one spiral channel can thus take place with the connection by means of the casting method at the casting locations. For this, at least one passage opening is then to be provided in the outer shell in connection with the gap, via which lost cast cores for producing the thermally insulating gap can be removed.

If the inner part is formed of a metal sheet formed by means of a deep drawing process, it has a particularly advantageous smooth surface for a particularly low-loss flow guidance. If the inner part is formed of the metal sheet having low roughness depths, which has a lower wall thickness than the outer shell of the—formed for example as a sand cast part—spiral channel, the flowing through of the turbine housing coincides with a comparatively low heat loss of the exhaust gas. An exhaust gas aftertreatment arranged downstream of the turbine housing can thereby be brought to the operating temperature necessary for the effective aftertreatment of the exhaust gas in a comparatively short time.

In addition to the function as a supporting corset and the force transfer function, the outer shell of the spiral channel surrounding the inner part also serves as a safety device in the case that a damage occurs at the turbine wheel, for example a blade breakage.

In an advantageous manner the inner part, particularly welded to the guide baffle and/or to an intermediate wall delimiting two spiral channels from each other, can be formed in a gas-tight manner. In this case, passage openings in the outer shell provided for removing the casting cores can remain unsealed, as the outer shell does not have to ensure the tightness of the turbine housing. The connection of the inner part to the guide baffle and/or the intermediate wall can take place in a form-fit manner.

Particularly when connecting the inner part to the spiral channel by means of the casting method, it is advantageous to first connect the inner part to the guide baffle by welding or by form-fitting.

If the turbine is formed with two flutes, an automatic welding process, particularly a laser or electron beam welding process can be used for connecting the inner part with the intermediate wall separating the two spiral channels from each other. The guide vane can hereby also be formed in one piece with the intermediate wall, and this integral part can then be welded to the inner part in a gas-tight manner. The casting of the inner part connected to the guide baffle and formed to the intermediate wall into the turbine housing can then take place in the manner that the guide baffle and the inner part or only the guide baffle are connected to the spiral channel at least in regions by means of casting. The intermediate wall can be connected to the spiral channel in a form-fit manner.

In a further advantageous embodiment of the invention, the outer shell is formed in two parts, wherein a second outer part shell is fixed to a first outer part shell connected to the guide baffle, particularly welded in a gas-tight manner. The inner part can thus be fixed to the second outer part shell at least via the guide baffle, wherein, after the introduction of the inner part, the first outer part shell can be connected to the second outer part shell in a gas-tight manner, for example by welding. Alternatively, the outer part shells can be fixed to each other in a form-fit manner. In the case of the outer shell formed in two parts, the passage opening in one of the outer part shells can then be omitted, as no cast cores have to be removed from the thermally insulating gap.

As long as the two outer shells are connected to each other in a gas-tight manner, a low requirement has to be made of the gas tightness of the inner part. A production effort for the inner part is thus comparatively low. If the inner part is connected to the two outer part shells in a gastight manner, the thermally insulating gap between the inner part and the outer part shells as a radial direction is formed as a space closed in itself. For connecting the inner part to one of the outer part shells to both outer part shells, a welding method can be used. Alternatively, a form-fit connection of the inner part and at least one outer part shell is possible.

In a further advantageous arrangement of the invention, the guide baffle is connected to the turbine housing with play in the direction of the rotational axis, particularly to a bearing housing that can be fixed to the turbine housing. With thermal alternating stresses of guide baffle and the turbine housing, a free movement possibility is thus given in the direction of the rotational axis, particularly towards the bearing housing.

The turbine housing can comprise a sealing element, by means of which the turbine housing can be sealed with regard to a bearing housing of the exhaust gas turbocharger. The sealing element can hereby be arranged in a region, in which the guide baffle has play with regard to the bearing housing that can be fixed to the turbine housing. If such a sealing element, for example a thermal compensation ring, is provided, a particularly effective gas tightness of the turbine housing is given.

It has finally been shown to be advantageous if the guide baffle has a plurality of fixed guide blades. Such a guide baffle is comparatively robust, operationsafe and cost-efficient.

A further advantage is the cost-efficient manufacture of the components of the turbine housing.

According to a further aspect of the invention, the above-mentioned object is solved by a method for producing a turbine housing for an exhaust gas turbocharger of a drive assembly with the following steps:

a) providing a turbine housing part with at least one spiral channel, which can be coupled to an exhaust gas line of the drive assembly, b) providing a guide baffle, which can be arranged in a transition region between the at least one spiral channel and a receiving chamber for a turbine wheel to which exhaust gas can be applied downstream of the at least one spiral channel, said wheel being rotatably received in the turbine housing around a rotational axis, c) arranging the guide baffle fixed to the turbine housing, wherein the guide baffle is adhesively connected to the turbine housing at least in regions during the arranging fixed to the turbine housing according to step c).

The preferred embodiments and advantages described for the turbine housing according to the invention are also valid for the method for producing a turbine housing according to the invention.

The invention will become more readily apparent from the following description of preferred embodiments thereof with reference to by the accompanying drawings, in which the same or functionally the same elements are provided with identical reference numerals.

DESCRIPTION OF VARIOUS EMBODIMENTS

Figure 1:
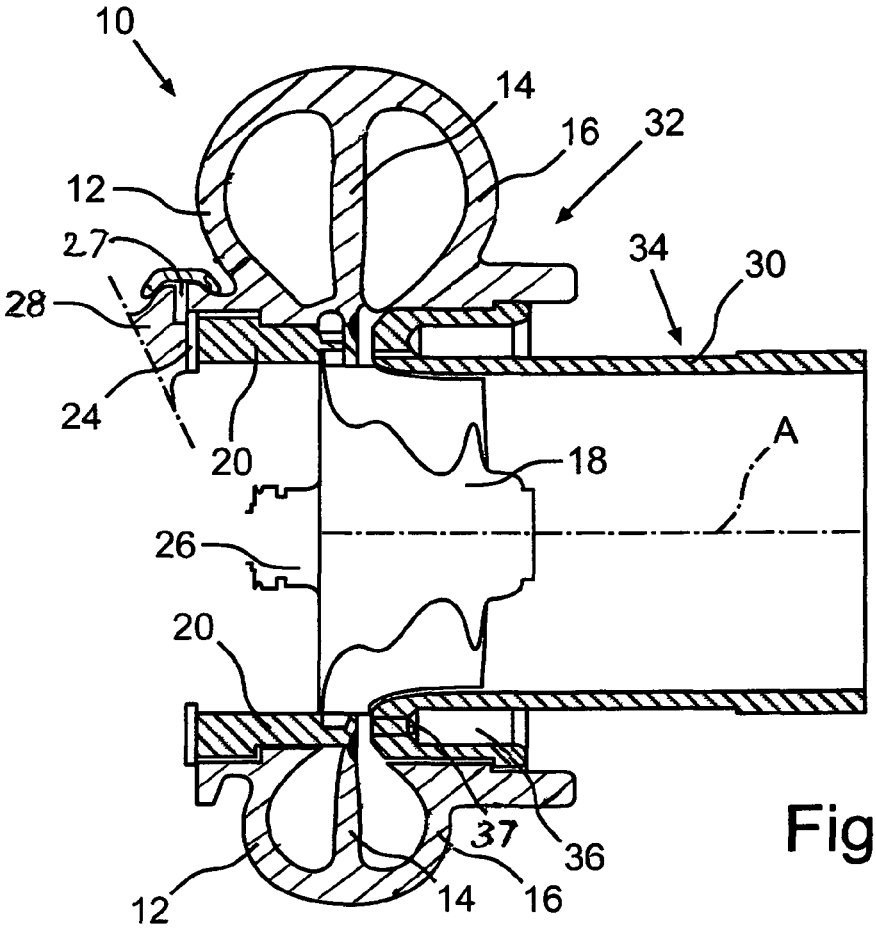
FIG. 1 is a sectional view of a turbine housing with two flutes for an exhaust gas turbocharger of a charged internal combustion engine, where a guide baffle is welded to a face side to an intermediate wall formed between two spiral channels.

A turbine housing 10 with two flutes for an exhaust gas turbocharger of a charged internal combustion engine shown in cross-section in FIG. 1 comprises a first spiral channel 12 which is separated from a second spiral channel 16 by means of an intermediate wall 14. A guide baffle 20 is arranged in a transition region between the first spiral channel 12 and a receiving chamber for a turbine wheel 18. The turbine wheel 18 is received in the turbine housing 10 rotatably about a rotational axis A and exhaust gas of the internal combustion engine exiting from the spiral channels 12, 16 can be applied to the turbine wheel 18.

Figure 2:
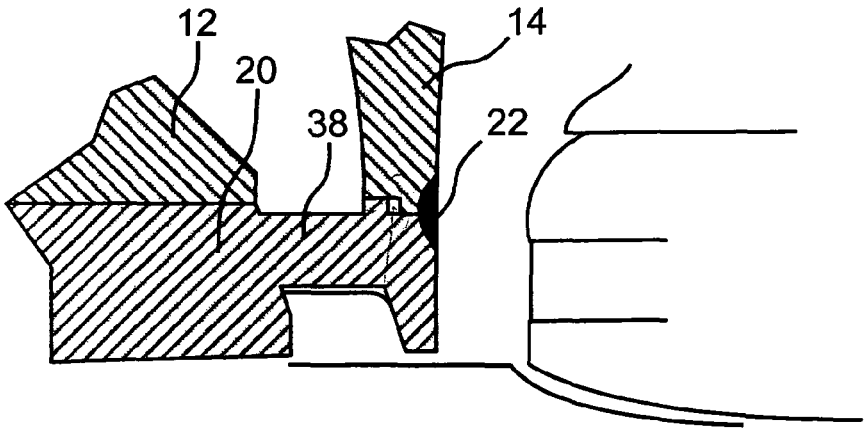
FIG. 2 shows an enlargement of a section of the turbine housing with two flutes according to FIG. 1 in the region of a weld seam formed between the intermediate wall and the guide baffle.

In the embodiment of the turbine housing 10 shown in FIG. 1, the guide baffle is welded to the intermediate wall 14 at a face side. A corresponding weld seam 22 is shown in FIG. 2 in an enlarged manner. The turbine housing 10 has a thermal compensation ring 24 at a face side of the guide baffle opposite the weld seam 22, by means of which ring the guide baffle 20 is sealed with regard to a bearing housing 28 of the exhaust gas turbocharger receiving a shaft 26. The guide baffle 20 is thus welded to the turbine housing 10 with play 27 in the direction of the rotational axis A towards the bearing housing 28 which is fixed to the turbine housing 10. The compensation ring 24 hereby provides for a compensation of different expansions of the guide baffle 20 and other components of the exhaust gas turbocharger at the various temperatures. The first spiral channel 12 is arranged at the bearing housing side.

The turbine housing 10 is formed in two parts according to FIG. 1, wherein a second partial housing 34 comprising an outlet channel 30 can be fixed to a first partial housing 32 comprising the spiral channels 12, 16. With a removed second partial housing 34, the guide baffle that can be introduced from the side of the bearing housing 28 into the turbine housing 10 is accessible in a very good manner for a welding method, for example a laser or electron beam welding method.

The second partial housing 34 has a cavity 36, into which an axial slider 37 serving as a flow guide element or coupled to a flow guide element can be introduced. The axial slider can be designed as a guide baffle. By means of such a flow guide element, presently not shown and for example having guide blades, flow states different from each other can be adjusted in the transition region between the second spiral channel 16 and the receiving chamber for the turbine wheel 18. A variability of the turbine is given thereby. A different large cross section can thus be adjusted in the transition region between the second spiral channel 16 and the receiving chamber for the turbine wheel 18, so that the requirements made for the provision of the charge air of the internal combustion engine can be fulfilled over a very wide speed region, particularly comprising low and medium speeds.

The axial slider that can be introduced into the cavity 36 of the second partial housing 34, by means of which slider different flow states can be adjusted in the transition region between the second spiral channel 16 and the turbine wheel, makes the provision of a turbo brake functionality (turbo brake) for braking the internal combustion engine possible.

The guide baffle 20 shown in FIG. 2 in an enlarged manner, which is welded to the intermediate wall 14 at the face side has fixed guide blades 38. By means of the fixed guide blades 38, the exhaust gas flowing through the first spiral channel 12 can be highly accelerated in the transition region between the spiral channel 12 and the turbine wheel 18 over a short path. A very efficient inflow of the turbine wheel 18 can be achieved thereby.

In the arrangement shown in FIG. 1, the cross section of the first spiral channel 12 and of the second spiral channel 16 has the same size, so that flow losses due to the wall friction of the exhaust gas are comparatively low compared to an asymmetric turbine with two flutes. By means of the guide baffle 20, however a retention capacity is still provided for the first spiral channel 12, which permits an efficient exhaust gas recirculation via a connection of an exhaust gas recirculation line to the first spiral channel. By means of the material jointure of the guide baffle 20 and the intermediate wall 14, it is ensured that different expansions of the components of the turbine housing 10 and the guide baffle 20 caused by temperature do not lead to leaks influencing the efficiency of the turbine.

The turbine housing 10 formed here in a symmetrical manner has thus properties of an asymmetric turbine housing without having to suffer the flow losses of an asymmetric spiral channel.

The guide baffle is presently formed as a fine cast part of a steel cast material, for example a material 1.4849. The first partial housing 32 of the turbine housing 10 comprising the spiral channels 12, 16 and the intermediate wall 14 is formed of the same steel cast material, but with a less exact casting method, for example as a sand cast part. Particularly due to the use of the same material for the guide baffle 20 and the intermediate wall 14, the connection of the guide baffle and the intermediate wall 14 can be carried out by means of the welding process in such a manner that a gas-tight connection is achieved.

Figure 3:
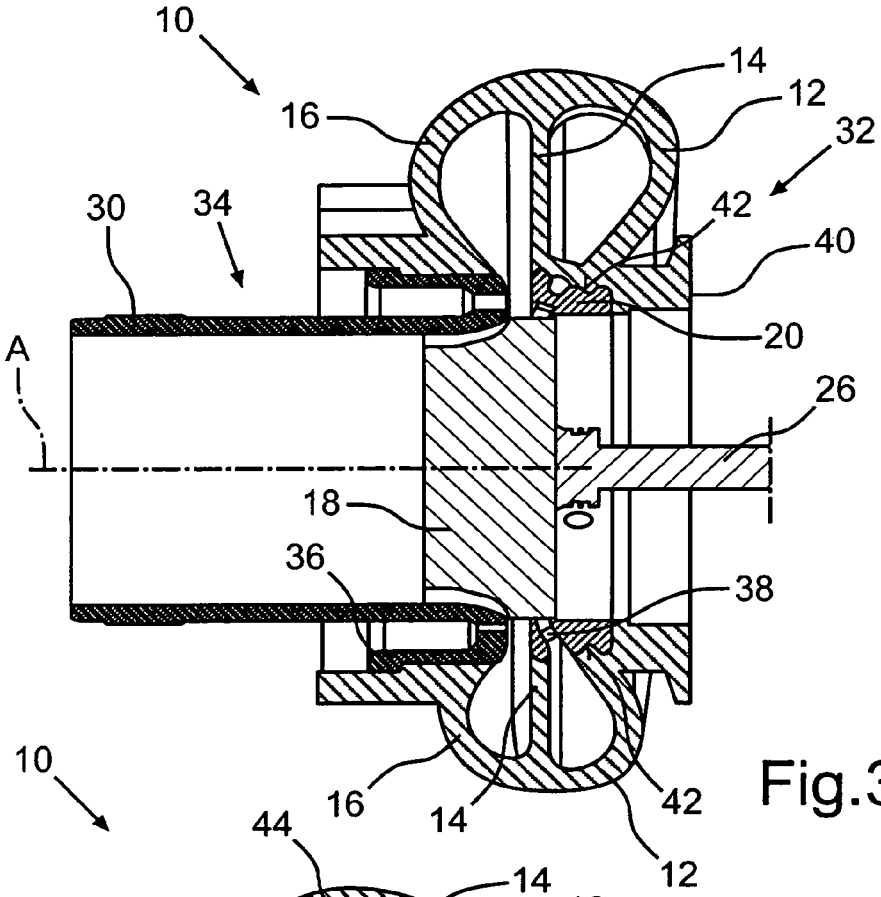
FIG. 3 shows a further embodiment of a turbine housing with two flutes in a sectional view, wherein a guide baffle is connected to the turbine housing by casting.

With the embodiment of the turbine housing 10 shown in FIG. 3, the guide baffle is connected to the first spiral channel 12 by material jointure and to the intermediate wall 14 by means of casting. The guide baffle 20 is hereby connected to the first partial housing 32 in a gas-tight manner at its face side near to a connection flange for connecting a bearing housing, not shown and at a face side near the intermediate wall 14.

Analogous to the embodiment of the turbine housing 10 shown in FIG. 1, the partial housing 34 comprising the outlet channel 30 is fixed to the first partial housing 32 comprising the spiral channels 12, 16. This second partial housing 34 further includes the cavity 36 for the variably adjustable axial slider as an example of a vario device. The retention of the exhaust gas for recirculating exhaust gas into the charge air takes place during the operation of the exhaust gas turbocharger via the guide baffle 20, which is arranged in the transition region between the first spiral channel 12 and the receiving chamber for the turbine wheel 18. A surface 42 of the guide baffle 20 connected to the spiral channel 12 and the intermediate wall 14 is presently formed in a corrugated manner, in order to achieve a particularly good anchoring of the guide baffle 20. In alternative embodiments, other profilings of the guide baffle enlarging the surface 42 can be provided.

The guide baffle is formed of a fine cast part of a steel cast material, for example the material 1.48949. Compared to this, the first partial housing 32 having the spiral channels 12, 16 of the turbine with two flutes is a sand cast part of the same steel cast material. This ensures a particularly good connection of the guide baffle 20 and the partial housing 32 by means of the casting method.

Figure 4:
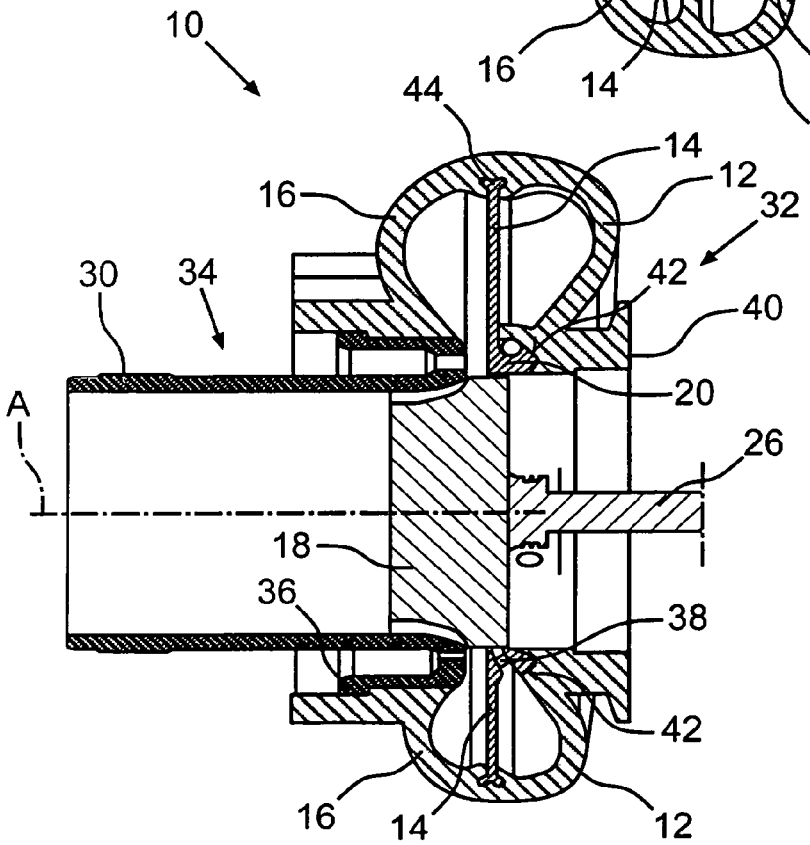
FIG. 4 shows a further embodiment of a turbine housing with two flutes in a sectional view, wherein an intermediate wall formed in one piece with the a guide baffle is connected to the turbine housing by casting.

With the embodiment of the turbine housing 10 shown in FIG. 4, the guide baffle 20 is pre-manufactured in one piece with the intermediate wall as a fine cast part from a steel cast material. This fine cast part is connected to the first partial housing 32 comprising the spiral channels 12, 14 when producing the turbine housing 10 by casting. In addition to the corrugated surface 42 of the guide baffle 20, an anchoring part 44 of the intermediate wall 14, which can for example comprise the presently shown T profile, ensures a particularly safe adhesive connection of the integral fine cast part to the partial housing 32.

The partial housing 32 can hereby be formed analogously to a housing of a turbine with one flute, so that the intermediate wall 14 formed in one piece with the guide baffle 20 ensures the separation of the spiral channels 12, 16 from each other. Alternatively, it is conceivable to provide an intermediate wall in the partial housing 32 starting from the turbine inlet flange, to which the intermediate wall 14 formed as a fine cast part is connected when casting the integral part. In the flow direction of the exhaust gas through the spiral channels 12, 14, the intermediate wall 14 formed in one piece with the guide baffle extends up to the tongue region, where the exit of the exhaust gas from the spiral channels 12, 16 takes place.

Figure 5:
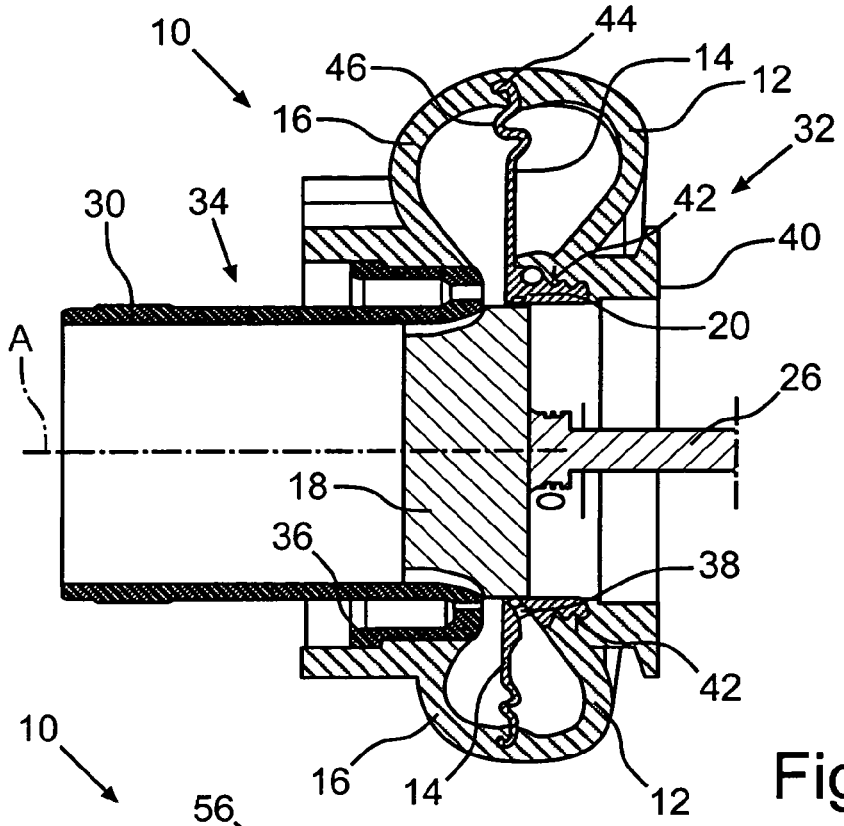
FIG. 5 shows a further embodiment of a turbine housing with two flutes in a sectional view, wherein the intermediate wall is formed of a metal sheet and is welded to the guide baffle, and the guide baffle and the intermediate wall are connected to the turbine housing by casting.

With the embodiment of the turbine housing 10 according to FIG. 5, the intermediate wall 14 and the guide baffle 20 also form an integral part, which is connected to the partial housing 32 by means of casting. The intermediate wall 14 also has an anchoring part 44, presently formed in a hook-shaped manner. However, in contrast to the embodiment shown in FIG. 4, the intermediate wall 14 is formed of a thin metal sheet, which is welded to the guide blade 20 in a gas-tight manner for producing the integral part. An automatic laser or electron beam welding process can be used hereby.

The intermediate wall 14 in the embodiment of the turbine housing 10 shown in FIG. 5 has a compensating region 46 presently formed in a corrugated manner. By means of this compensating region 46, different thermal expansions of the spiral channels 12, 16 of the guide baffle 20 and of the intermediate wall can be compensated. In alternative embodiments, the compensating region 46 can have a form deviating from the presently shown corrugated form. Also as with the embodiments shown in FIGS. 1 to 4, the partial housing 34 comprising the outlet channel 30 has the cavity 36, which is designed for receiving the vario element. The cross section that can be flown through can be changed in the transition region between the spiral channel 16 and the receiving chamber for the turbine wheel 18 by means of the vario element in such a manner that a turbo brake functionality of the turbine is given.

Figure 6:
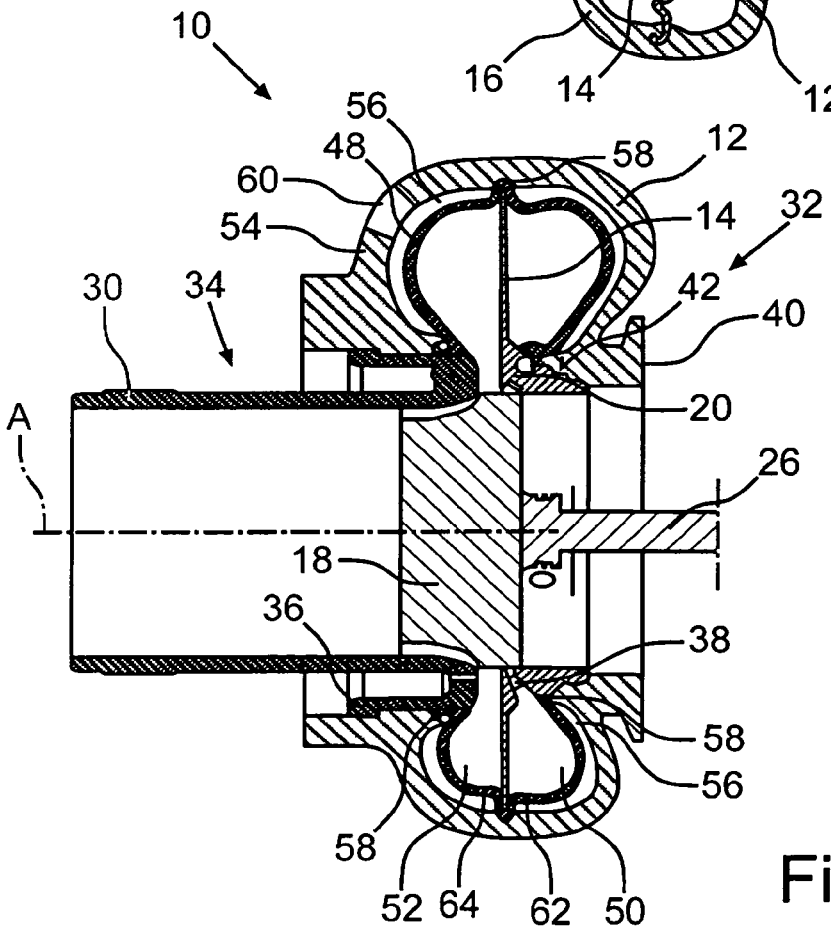
FIG. 6 shows a further embodiment of a turbine housing with two flutes in a sectional view, wherein a thermally insulating gap is formed between an inner part of a metal sheet and an outer shell of the spiral channel.

With the embodiment of the turbine housing 10 shown in FIG. 6, only one spiral channel 12 is provided by the partial housing as in a turbine housing with only one flute. The spiral channel 12 has however an inner part 48 formed of a metal sheet through which the exhaust gas flows. Two flutes 50, 52 independent of each other are separated at the inner part 48 by the intermediate wall 14 formed integrally with the guide baffle 20.

A thermally insulating gap 56 is formed between the inner part 48 and an outer shell 54 of the spiral channel 12. In that the inner part 48 is formed of a thin-walled metal sheet having a low heat capacity, which is additionally insulated thermally by the gap 56, comparatively hot exhaust gas leaves the outlet channel 30 during operation of the exhaust gas turbocharger. Exhaust gas aftertreatment devices arranged downstream of the outlet channel 30 can thereby be brought very quickly to the temperatures needed for an effective aftertreatment.

The inner part 48 is presently connected to the integral part comprising the intermediate wall 14 and the guide baffle 20 by means of welding, for example by means of a laser or an electron beam welding method. This integral part is formed as a fine cast part, wherein the guide baffle 20 is connected to the partial housing 32 by means of casting. For the defined fixing of the inner part 48 to the partial housing 32 welded to the integral part by means of the casting method, the inner part 48 has three anchoring parts 58. The positioning of the inner part 48 at the partial housing 32 during the casting takes place via these anchoring parts 58 functioning as casting locations.

For removing lost cast cores from the gap 56, the outer shell 54 has two passage openings 60, which are connected to the gap 56. The inner part 48 is formed in a gas-tight manner with the embodiment according to FIG. 6. The inner part 48 of metal sheet produced by a deep-drawing process has particularly smooth surfaces, whereby the flutes 50, 52 formed by the inner part 48 in cooperation with the intermediate wall can be flown through by exhaust gas in a particularly low-loss manner.

With the embodiment of the turbine housing 10 shown in FIG. 6, the inner part 48 is formed in two parts, wherein a first inner part shell 62 delimits the flute 50 in cooperation with the intermediate wall 14. The guide baffle 20 is arranged in the transition region between the flute 50 and the receiving chamber for the turbine wheel 18. A second inner part shell 64 of the inner part 48 delimits the flute 52 in cooperation with the intermediate wall 14 and is welded to the first inner part shell 62. In an alternative embodiment, the inner part 48 can also be formed in one part, particularly as a one-part metal sheet part, which can be connected to the integral part comprising the intermediate wall 14 or the guide baffle 20 or the intermediate wall 14 and the guide baffle 20.

In the embodiment of the turbine housing 10 according to FIG. 6, the partial housing 32 takes on a supporting function for the flow-guiding parts. With respect to this, these flow-guiding parts ensure the gas tightness. Furthermore, the partial housing 32 ensures a force transfer between the turbine inlet flange, the bearing housing (see FIG. 1) and the turbine outlet flange provided at the outlet channel 30. In the case of a breakage of a blade of the turbine wheel 18, the partial housing 32 additionally ensures a protection from damage of components surrounding the turbine housing 10.

Figure 7:
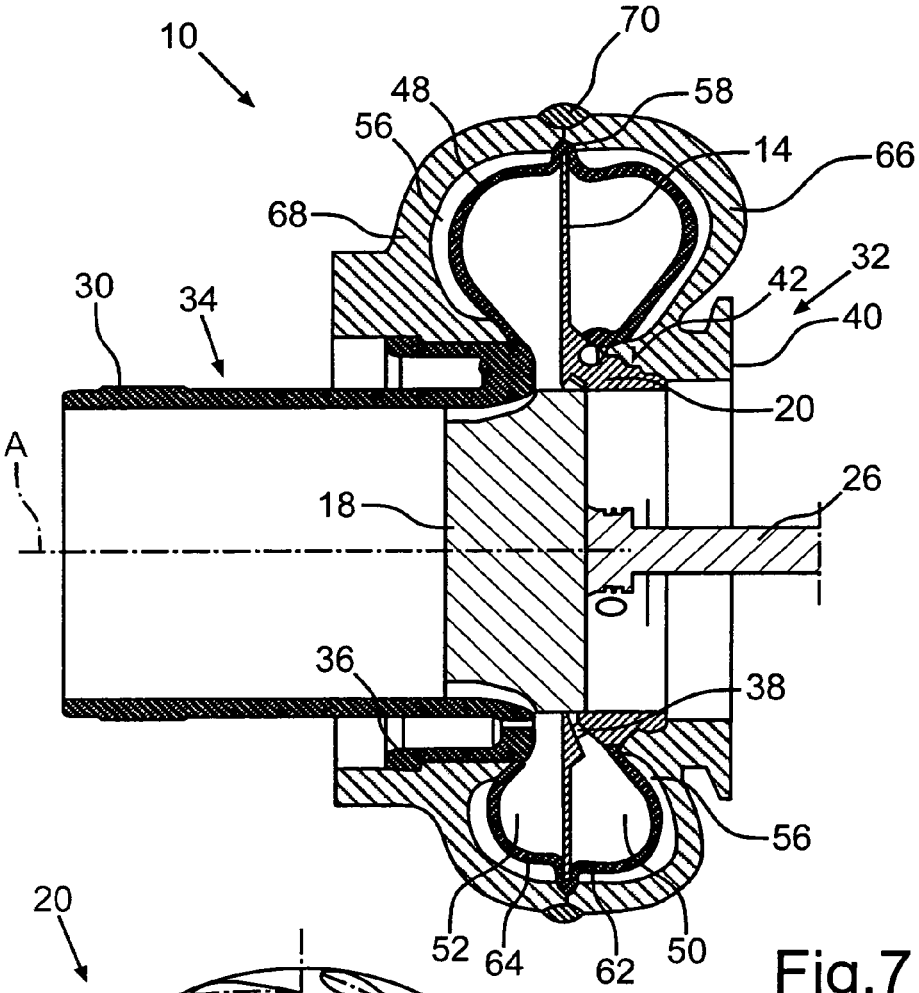
FIG. 7 shows a further embodiment of a turbine housing with two flutes in a sectional view, wherein a an outer shell surrounding the inner part of metal sheet is formed by two outer part shells welded to each other in a gastight manner.

The embodiment of the turbine housing 10 according to FIG. 7 corresponds largely to the embodiment shown in FIG. 6 in its design. The outer shell is however formed in two parts here and comprises a first outer part shell 66 connected to the guide baffle 20. This is connected to a second outer part shell 68 by welding. A corresponding weld seam 70 is arranged in extension of the intermediate wall 14 dividing the flutes 50, 52 centrally between the two outer part shells 66, 68.

The inner part 48, which comprises in the embodiment according to FIG. 6 the two inner part shells 62, 64 welded to each other, is connected to the first outer shell part 66 by casting the integral part of intermediate wall 14 and the guide baffle 14 connected to the inner part 48. The connection of the inner part 48 to the second outer part shell 68 then takes place, for example by welding, when welding the two outer part shells 66, 68 to each other.

By means of the connection of the outer part shells 66, 68 to the inner part 48, the thermally insulating gap 56 is closed in the radial direction. The outer part shells 66, 68 have no passage openings in contrast to the embodiment of the turbine housing 10 according to FIG. 6, A gas tightness of the gap 56 to the outside is ensured by the outer part shells 66, 68, the inner part 48 itself can be formed based on lower requirements to a gas tightness.

Figure 8:
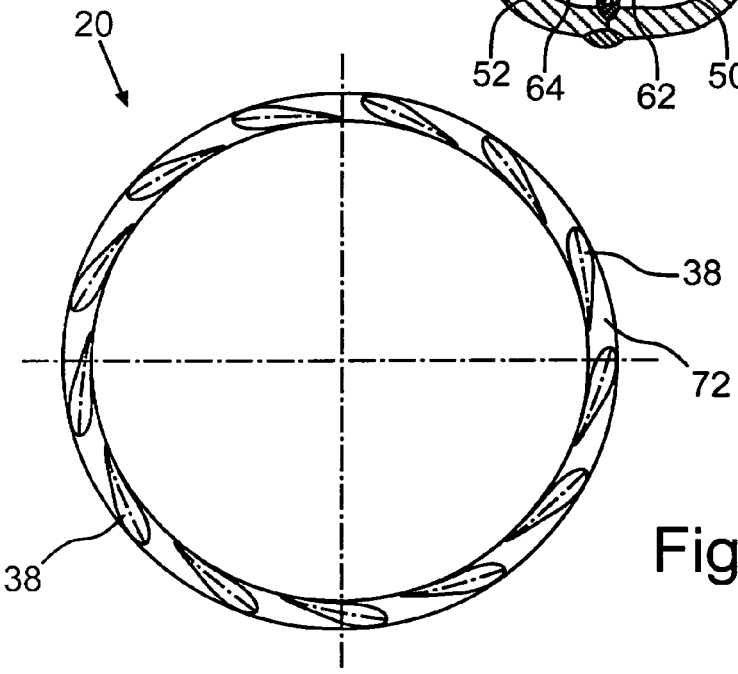
FIG. 8 shows a radial sectional depiction of a guide baffle for one of the turbine housings according to FIGS. 1 to 7.

FIG. 8 shows the guide baffle 20 for a turbine housing 10 shown in FIG. 1 to FIG. 7 in a radial section through the guide blades 38. It can be seen hereby that the guide baffle 20 comprises a support ring 72 comprising the face side, at which the guide blades 38 which are droplet-shaped in their profile, are arranged.

What is claimed is:

1. A turbine housing (10) for an exhaust gas turbocharger of a drive assembly, with at least first and second spiral channels (12, 16) which can be coupled to an exhaust gas line of the drive assembly, with a receiving chamber for a turbine wheel (18) arranged downstream of the spiral channels (12, 16) to which exhaust gas can be applied, said turbine wheel (18) being received in the turbine housing (10) so as to be rotatable around a rotational axis (A), and a tubular guide baffle (20) provided at one end with guide blades (38) and being fixed to the turbine housing (10) so that the guide blades (38) are arranged in a transition region between one of the spiral channels (12, 16) and the turbine wheel receiving chamber, the spiral channels being separated from each other by an intermediate metal sheet (14) which, at its radially inner end is one of formed integrally with and welded to the guide blade end of the tubular guide baffle (20), the tubular guide baffle (20) being attached at its opposite end to a bearing housing (28) of the turbocharger in a gas-tight manner.

2. The turbine housing according to claim 1, wherein for fixing the guide baffle (20) to the turbine housing (10) the guide baffle (20) is welded to the turbine housing (10) to provide for a gas-tight joint.

3. The turbine housing according to claim 1, wherein the guide baffle (20) is cast into the turbine housing (10) at the guide blade end thereof in a gas-tight manner.

4. The turbine housing according to claim 1, wherein a surface (42) of the guide baffle (20) connected to the turbine housing (10) is formed in a profiled manner.

5. The turbine housing according to claim 1, wherein the turbine housing (10) is formed in at least two parts, wherein a second partial housing (34) comprising an outlet channel (30) can be fixed to the first partial housing (32) of the turbine housing (10) comprising the at least one spiral channel (12, 16).

6. The turbine housing according to claim 1, wherein the intermediate wall (14) has an anchoring part (44) embedded into the turbine housing (10).

7. The turbine housing according to claim 1, wherein the intermediate wall (14) has at least one compensating region (46) compensating for a different thermal expansion of the spiral channels (12, 16) and of the guide baffle (20).

8. The turbine housing according to claim 1, wherein as flow guide element an axial slider (37) is movably arranged in the transition region between the second spiral channel (16) and the receiving chamber for the turbine wheel (18), by means of which flow guide element at least two flow states different from each other can be provided in the transition region.

9. The turbine housing according to claim 1, wherein for conducting exhaust gas to the receiving chamber has a flow cross section of the second spiral channel (16) which is at least essentially the same as a flow cross section of the one spiral channel (12).

10. The turbine housing according to claim 1, wherein the turbine housing (10) and the guide baffle (20), are formed as a fine cast part or exact cast part and consist of the same material.

11. The turbine housing according to claim 1, wherein the at least one spiral channel (12) has an inner part (48) consisting of a metal sheet, and receiving the exhaust gas, wherein a thermally insulating gap (56) is formed between an outer shell (54) of the at least one spiral channel (12) and the inner part (48).

12. The turbine housing according to claim 11, wherein the inner part (48), is welded at least to one of the guide baffle (20) and an intermediate wall (14) separating two spiral channels from each other, the welds being formed in a gas-tight manner.

13. The turbine housing according to claim 11, wherein the outer shell is formed in two parts, wherein a second outer part shell (68) is fixed to a first outer part shell (66) which is connected to the guide baffle (20) in a gas-tight manner.

14. The turbine housing according to claim 1, wherein the guide baffle (20) is connected to the turbine housing (10) with play (27) in the direction of the rotational axis (A), towards a bearing housing (28) that is fixed to the turbine housing (10).

15. The turbine housing according to claim 1, wherein the turbine housing (10) has a sealing element, in the form of a thermal compensation ring (24), by means of which the turbine housing (10) can be sealed with regard to a bearing housing (28) of the turbocharger.

16. The turbine housing according to claim 1, wherein the guide baffle (20) has a plurality of fixed guide blades (38).

* * * * *